United States Patent [19]

Theilacker

[11] Patent Number: 4,706,862

[45] Date of Patent: Nov. 17, 1987

[54] WEB THREADING APPARATUS, PARTICULARLY FOR THREADING OF A ROTARY PRINTING MACHINE, OR SIMILAR PAPER HANDLING SYSTEM

[75] Inventor: Klaus Theilacker, Friedberg, Fed. Rep. of Germany

[73] Assignee: M.A.N.Roland Druckmaschinen AG, Offenbach am Main, Fed. Rep. of Germany

[21] Appl. No.: 774,042

[22] Filed: Sep. 9, 1985

Related U.S. Application Data

[63] Continuation-in-part of Ser. No. 588,660, Mar. 12, 1984, abandoned.

[30] Foreign Application Priority Data

Mar. 15, 1983 [DE] Fed. Rep. of Germany ..... 3309121

[51] Int. Cl.[4] ..... B65H 20/16; B41F 13/02; H01F 1/22

[52] U.S. Cl. ..... 226/92; 101/228; 335/219

[58] Field of Search ..... 226/91, 92, 93, 1, 173; 101/228, 219; 24/303; 335/219, 303, 306, 285

[56] References Cited

U.S. PATENT DOCUMENTS

| | | | |
|---|---|---|---|
| 3,024,392 | 3/1962 | Baermann | 335/306 X |
| 3,097,406 | 7/1963 | Yarborough | 24/303 X |
| 3,212,546 | 10/1965 | Lind | 335/303 X |
| 3,618,174 | 11/1971 | Schainholz et al. | 24/303 |
| 3,629,756 | 12/1971 | Holtz | 335/303 X |
| 3,629,905 | 12/1971 | Cote | 24/303 X |
| 3,761,001 | 9/1973 | Bolza-Schunemann et al. | 101/228 |
| 4,111,122 | 9/1978 | Kutzner et al. | 101/228 |
| 4,138,074 | 2/1979 | Ross et al. | 226/92 X |
| 4,187,968 | 2/1980 | Winterholler et al. | 226/92 |
| 4,255,837 | 3/1981 | Holtz | 24/303 |
| 4,336,806 | 6/1982 | Eldridge, Jr. | 335/303 X |
| 4,370,927 | 2/1983 | Fischer | 101/228 |
| 4,480,801 | 11/1984 | Stone | 226/92 X |

FOREIGN PATENT DOCUMENTS

| | | | |
|---|---|---|---|
| 133544 | 1/1979 | German Democratic Rep. | 101/228 |

OTHER PUBLICATIONS

Rheinmagnet brochure A482.

*Primary Examiner*—Harvey C. Hornsby
*Assistant Examiner*—Scott J. Haugland
*Attorney, Agent, or Firm*—Frishauf, Holtz, Goodman & Woodward

[57] ABSTRACT

For securing a web of material to the hook of a web threading apparatus, two flexible, magnetic plate elements are provided, between which the leading end of the web of material to be threaded can be clamped and which are connected with a loop for attachment to the hook. To maintain the web in alignment with respect to a plane defined by a longitudinal slit in a guide tube, and a guide tube axis, the magnetic plate elements are placed at the trailing end of a pulling connection (21) of pointed triangular form, having an intermediate, longitudinally resilient portion to absorb pulling shocks, and a head portion which has a lateral bead and can be threaded over open eye portions (33) of connecting elements (32) extending through the slit (31) of the guide track tube (30).

7 Claims, 5 Drawing Figures

WEB THREADING APPARATUS, PARTICULARLY FOR THREADING OF A ROTARY PRINTING MACHINE, OR SIMILAR PAPER HANDLING SYSTEM

This application is a continuation-in-part of my application Ser. No. 588,660, filed Mar. 12, 1984, now abandoned.

Reference to related patents, assigned to the assignee of the present application, the disclosure of which is hereby incorporated by reference:

U.S. Pat. No. 4,187,968, WINTERHOLLER et al;

U.S. Pat. No. 4,370,927, FISCHER.

The present invention relates to a web threading apparatus for a rotary printing machine or similar paper handling system.

BACKGROUND

Various kinds of web threading apparatus are used both in web-fed rotary printing machines and in other paper handling machines in the paper industry. As a rule, they include guides extendling laterally beside a long edge of the web, along the intended threading course, with a pulling or threading element movable within these guides. A catch of some kine is secured to the pulling element and extends over a portion of the width of the web.

For securing the web to the catch, provisions have heretofore been made for tapering the leading end of the web to a point in the threading direction and then securing it by means of adhesive tapes or paster tabs to a loop to be attached to the catch. In order to prevent edge tearing of the web, its longitudinal edges were additionally reinforced with adhesive tapes in the tapered area. Since these operations must be performed on the end of the web suspended freely in the air between the supply roll and the rollers of the machine into which the web is to be threaded, they are time consuming, and should they be inexpertly performed they can easily result in loosening of the paster tabs during the threading operation.

THE INVENTION

It is accordingly the object of the invention to create an apparatus that simplifies the connecting of the web with the catches or hooks of the threading apparatus.

Briefly, two magnetically responsive, magnetically adhering flexible plate elements are connected to a pulling loop, for engagement with the hook of a threading or web pulling mechanism of any suitable and well-known type. The flexible plate elements are shaped for positioning over the leading end portion of the paper web to be threaded, to clamp the leading edge portion therebetween, to provide a large-area frictional contact. The plate elements may be made of magnetic particles embedded in plastic foils, and so oriented that unlike poles face each other, when the plates are placed above each other, with the web therebetween; or only one of the foils may carry magnets, the other carrying soft magnetic material, such as a metal foil, a wire mesh or the like. In accordance with a preferred feature of the invention, the plate elements are connected by a hinge, for example a plastic "living hinge", so that they can merely be folded above each other, and retain the leading end portion of the web to be threaded therebetween.

The invention is applicable primarily to printing machines, especially rotary printing machines, but can be used with any paper handling system requiring position of a web in a predeterminend path.

When the invention is put to use, not only is the time needed for connecting the web to the hook shortened, but also, since the magnetic field that holds the plate elements together is effective over the entire area of the leading end of the web, this holding force is introduced into the web more uniformly. As a result, there is less danger that the paper web may tear during the threading operation, since localized peaks of tensile force at the adherent points no longer occur.

In accordance with a feature of the invention, a holding connecting element is provided to connect the magnetically responsive plate elements to a pulling cable or the like which retains a predetermined alignment position of the plane of the web with respect to the pulling cable. The pulling cable is guided in a tubular guideway, for example of essentially circular cross section, which has an axially extending slit. One or, preferably, a plurality of guide elements or guide plates extend through the slit so that the plane of the guide plates or guide elements will be essentially along a plane passing through the axis of the tubular element and the longitudinal extent of the slit. This plane also defines the pulling plane of the web to be threaded into the printing machine or other paper handling apparatus. The laterally projecting plates or pulling elements, coupled to the pulling cable, are then coupled to the web by an elongated tapering connecting strip which includes elastic material which has shock-absorbing qualities to thereby provide for gentle threading of the web into the printing machine or similar paper handling apparatus, while maintaining the planar alignment of the web with respect to the pulling guideway.

In accordance with the invention, the overall connection between the pulling cable and the web is such that the elements are essentially planar, or sheet or plate-like, or flat flexible elements, which are so arrange that they cannot essentially leave their predetermined respective aligned planes, defined, for example, by a plane passing through the slit and the axis of the tubular guideway. This arrangement then guides the web to be threaded, upon insertion into the printing machine, in respective planes defined by the guideway, for example to guide the web about turning rods, turning rod systems, or the like.

The interposition of a flexible element, preferably one which has shock-absorbing or stretchable characteristics, prevents the occurrence of sudden jars or transmission of pulling shocks to the web which might otherwise lead to tearing of the web.

DRAWINGS

DETAILED DESCRIPTION

Figure 1:
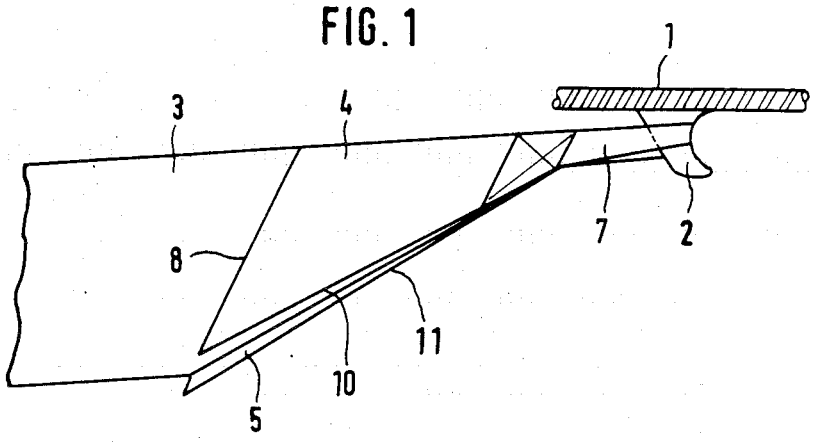
FIG. 1 is a perspective view of an embodiment of a threading element plate according to the invention.

The known web threading apparatus, not shown here in further detail, includes a threading or pulling element 1, for instance a chain or cable, to which a catch or hook is secured. The pulling element 1 is disposed laterally beside a paper web 3, which is to be threaded by means of the threading apparatus into some paper handling machine, for instance a printing machine.

For connecting the hook 2 with the web 3, two plate elements 4, 5 are provided, between which the leading end of the web 3 is fixed. To this end, the plate element 4 is formed by a plastic foil in which particles of a permanent-magnetic material are embedded. The particles are embedded in such the foil in an orientation that all the poles face one face side of the plate element 4, specifically that face side which is placed upon the web 3. The other plate element 5 is formed as a flexible metal foil of some magnetizable material, such as soft iron. The width of the plate elements 4, 5 at the rear edges 8, 9 is suitably equal to the width of the web of material to be threaded. The outer lateral edges 10, 11 extend obliquely toward the hook 2. The two plate elements 4, 5 are connected with one another by a back strip 6 of flexible material. A loop 7 for attachment to the hook 2 is non-releasably secured to the plate element 4. The back strip 6 may alternatively be omitted. In that case, each end of the loop 7 can be secured to a respective one of the plate elements 4, 5.

OPERATION

If a web of material is to be attached to the threading apparatus with the fastening device according to the invention, the plate elements 4, 5 are folded over the leading end of the web 3. Next the portion of the paper web 3 that protrudes out beyond the plate elements 4, 5 can be cut off. When the plate elements 4, 5 are folded together, they clamp the web between them, exerting frictional force over a large area. All that remains to be done is to hang the loop 7 over the hook 2.

The width of the plate elements 4, 5 is suitably selected to be equal to the width of the web of material to be threaded.

A metal mesh of magnetizable material may also be used instead of a metal foil 5.

Both plate elements may be made of plastic foil with particles of permanent-magnetic material embedded therein. The permanent-magnetic particles are preferably so positioned and polarized that the two plate elements 4, 5 attract one another when the plate elements are folded together, with the web interposed. In such an arrangement, all like poles of the permanent-magnet particles of a plastic foil are oriented toward the same face side. Similarly, the second plate element will have all like poles oriented towards the same face side, with, of course, opposite poles facing each other when the plate elements are folded together.

Figure 3:
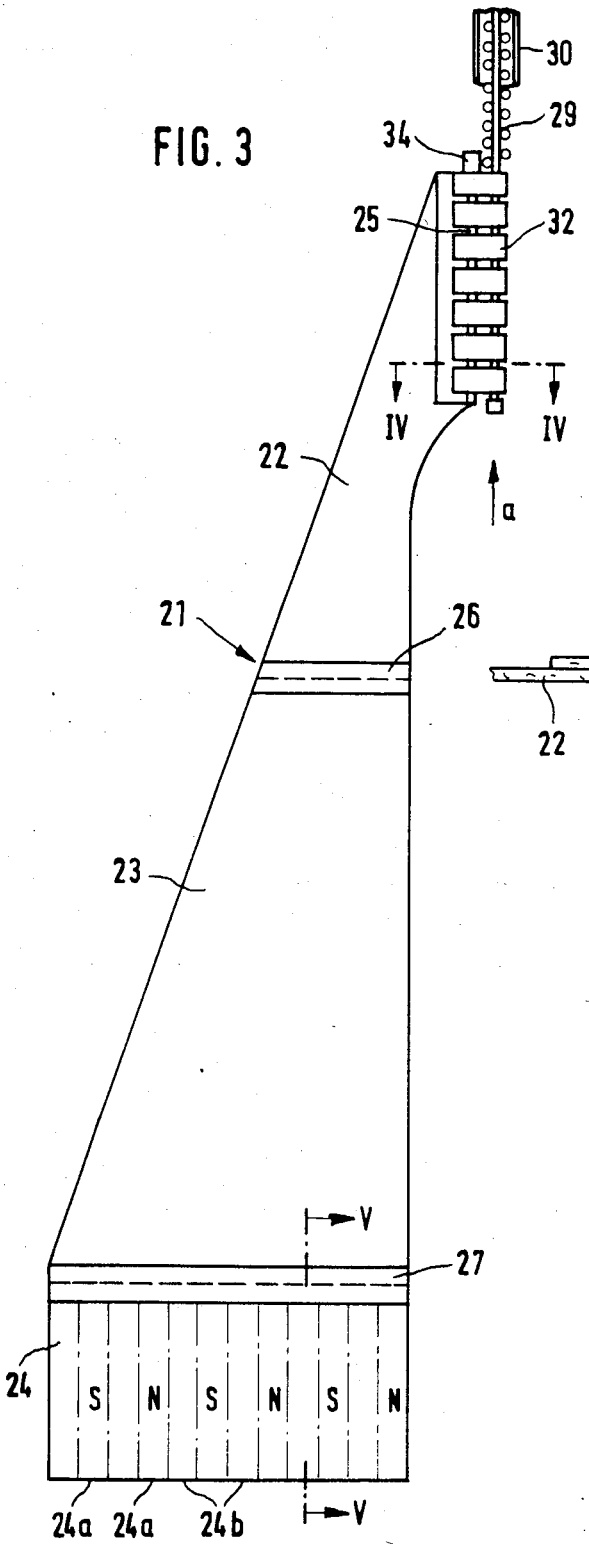
FIG. 3 is a schematic top view of a web holding element, including a portion of the guideway and pulling cable for threading a web into a printing machine.

FIG. 3 illustrates an arrangement which is a preferred pulling arrangement to pull a web through a printing machine, for example utilizing a construction as generally illustrated in U.S. Pat. No. 4,370,927, FISCHER, the disclosure of which is hereby incorporated by reference, assigned to the assignee of the present application.

FIG. 3 is a plan view of a holding connecting element 21 which, essentially, has three portions or parts, namely a head portion 22, an intermediate or connecting portion 23, and an attachment portion 24.

The head portion 22 is made of textile material which is coated on both sides with a plastic. It is so constructed that it has only little elasticity, that is, is quite stiff, and is resistant to twist out of its major plane—in the drawing, the plane of FIG. 3. A filler or bead strip, for example made of a portion of cable 5, is adhesively secured in an edge of the folded-over web forming the head portion 22. The cable or rope portion 25 terminates in a head or abutment end 34. FIG. 3 illustrates the cable, schematically, by broken lines, where not visible.

The head portion 22 tapers or flares outwardly towards its rear or trailing end, when threaded into a printing machine. Two adhesive strips 26 are used to adhere the relatively stiff head portion 22 to more flexible and longitudinally shock-absorbing intermediate portion 23.

The intermediate portion 23 is made of an elastic plastic material, preferably a polyurethane, for example of the type known under the trademark "VULKOLAN". This material has, in the direction of pull, a spring constant of about 0.5 to 0.1 kp/mm (1 kp=1 kg-force). The intermediate or shock absorbing or more resilient portion flares outwardly towards its lower end, to be then connected by a butt connection, with superimposed connecting strips 27, to the actual pulling or attachment portion 24.

Figure 2:
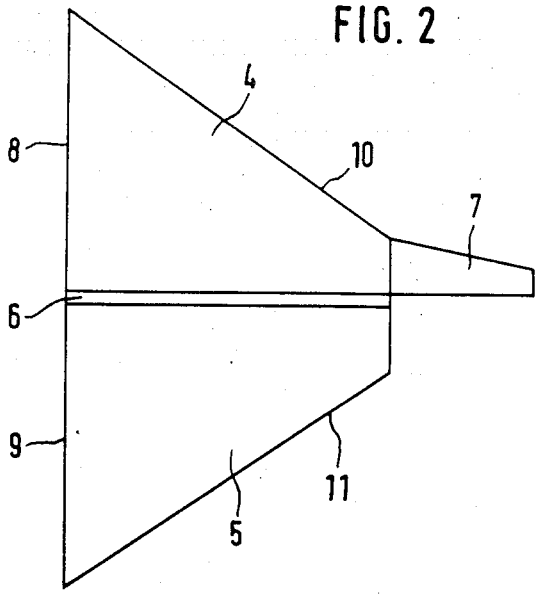
FIG. 2 is a view of the plate element of FIG. 1 from above.

The attachment portion 24 is made of two flexible magnetic cover elements 28, 28′ which may, for example, be similar to the flaps 4, 5 (FIGS. 1, 2). The leading end of the paper web to be threaded into the printing machine is placed between the flaps 28,28′. Preferably, the flaps 28, 28′ are made of a plastic material within which magnetic particles are included, so arranged that the magnetic particles are placed in parallel adjacent longitudinal strips of differential polarity—see FIG. 3. The regions 24*a* have permanent magnetic particles included therein, so placed on the respective flaps 28, 28′ (FIG. 5) that particles which form a South pole at the interface on one of the flaps, e.g. flap 28, will face particles defining a North pole on the adjacent flap, then flap 28′. The regions between the magnetized strips, shown at 24*b* inn FIG. 3, are of plastic material which does not include any soft iron or other magnetically active materials; they may, however, have an outer surface coating of a suitable magnetic material, e.g. chromium oxide, to provide a magnetic return path to form complete magnetic circuits. The regions 24*b* may also be omitted. The holding connecting element of FIG. 3 is used in combination with a threading arrangement, for example as shown in the referenced U.S. Pat. No. 4,370,927. As described in this patent, a flexible transport cable or chain 29 is provided, located within a tubular guide 30. The tubular guide 30 is formed with a longitudinal slit 31. The referenced patent shows a pulling hook, similar to hook 2 (FIG. 1); rather than using such a pulling hook, however, and in order to maintain the web 3 (FIG. 1), and not shown in FIG. 3, in a predetermined alignment or plane with respect to the axis of the tube 30 (FIG. 4), a connecting arrangement is used which includes pulling connections operable in the plane defined by the slit 31 in the guide tube 30 and the axis of the guide tube, within which the cable or chain 29 operates.

Figure 4:
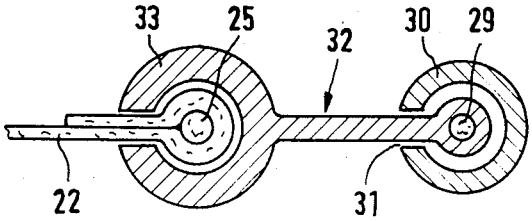
FIG. 4 is a section along line IV—IV of FIG. 3.
Figure 5:
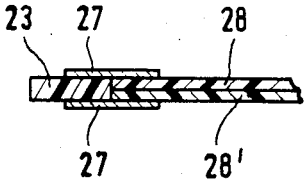
FIG. 5 is a section along line V—V of FIG. 3.

Holding elements 32 are coupled to the cable 29 extending through the slit 31 of the guide tube 30—see FIG. 4. The holding elements 32 may be narrow plates, rods, or the like, which terminate in ring-shaped end portions 33, likewise formed with a terminal slit. The ring-shaped end portions 33 of the projecting connecting elements 32 are threaded over the cable or rope ends 25 in the folded end parts of the head portion 22 until the uppermost one of the projecting connecting elements 32 engages the abutment or terminal 34 on the rope or cable element 25. Preferably, the projecting connecting elements 32 are staggered along the end of the cable 29, with some clearance therebetween, for example obtained by suitable flexible spacers, as best seen in FIG. 3. A plurality of such elements 32 are provided, of sufficient number and sufficient axial extent—with respect to the cable 29—to maintain planar alignment of the respective elements 32 in the plane defined by the slit 31 and the center of the tubular guideway 30.

In operation, tensile force applied on the cable 29 will be transmitted via the projecting connecting elements 32 to the head portion 22 of the holding connecting element 21. The pulling force will be applied against the abutment end 34 thereon, and can be distributed longitudinally by suitable spacers, also located adjacent each one of the ring-shaped portion 33 of the projecting connecting elements 32.

For threading, the position of the slit 31 will define the position of the projecting connecting elements 32. Since the entire holding connecting element 21 is made of flat, planar parts, the web 3 (not shown in FIG. 3) clamped between the flaps 28 of the attachment portion 24 cannot move substantially out of the respective plane thereof. The arrangement thus permits guiding the web into the printing machine in respective planes defined by the slit 31 and the axis of the guide tube 30. For example, the web can be guided about turning rod systems or the like.

Upon threading, the elastic intermediate portion 23 provides for gentle handling of the web, since sudden pulling peaks will be damped by the elastic portion 23, thereby effectively preventing tearing of the web 3 (FIG. 1) being threaded into the machine. Fixed guide elements within the printing machine, then, need not be used or installed in the printing machine. Twist of the cable 29 will not affect the position of the plane of the web in which it is threaded due to the constraint effected by the slit 31 in relation to the cable 29 and the holder 32 which, again, surround to a major extent the end portion of the holding connecting element in the region of the cable or rope part 25 but, otherwise, tend to retain the head portion 22 in the same given plane—see FIG. 4. Thus, a pulling element 29 can be used which is effectively resistant to extensive twist, such as a chain or a steel cable, since resiliency of the pulling element is not required; resiliency is obtained by the intermediate portion 23. Yet, the element 29 permits some deflection about its longitudinal axis; a small structure can be provided since the pulling element 29 may be made of high-strength steel cable. thus permitting use of a tubular guide 30 of minimum diameter. This is important when threading paper webs in printing machines in which the spacing between cylinders, in threading or quiescent position, may be only in the order of about 1.6 mm; use of heavy resilient pulling elements for the cable 29 requires substantially greater spacing between cylinders of a printing machine in order to insure proper threading.

Various changes and modifications may be made, and features described in connection with any one of the embodiments may be used with any of the others, within the scope of the inventive concept.

I claim:

1. For and in combination with a rotary printing machine having, a pulling means (1, 2; 29, 32) for pulling a web (3) through the machine, and applying, in operation, a pulling force on the web, a paper web threading apparatus having, a pulling connection (7; 21, 22, 34) for attachment to the pulling means, a tubular guide track (30) having a longitudinally. extending slit (31), the pulling means (29) being located within the tubular guide track, the slit (31) and a longitudinal axis of the tubular guide track defining a pulling plane;

and comprising a plurality of projecting connecting elements (32) coupled to the pulling means (29) and extending through said slit (31), the respective ones of said projecting elements being longitudinally staggered along said pulling means, the projecting connecting elements including connection ends (33) formed as slit rings;

a pulling and holding connection element (21; 22–25) for coupling with the connection ends (33) of the projecting connecting elements (32), the pulling and holding element comprising a head portion (22) of flat, planar sheet material characterized by being essentially resistant to twist out of its major plane, an intermediate connection element (23) of flat planar sheet material characterized by being resistant to twist out of its major plane and resilient in the direction of pulling force being applied by the pulling means, and two magnetically responsive, magnetically jointly adhering flexible plate elements (28, 28'), shaped for positioning of the leading end portion of the web to be threaded between said plate elements, said plate elements retaining said leading end portion therebetween by frictional clamping force exerted by the magnetic adhesion of the flexible plate elements, and wherein the head portion includes a threading connecting edge defining a bead (25) for threading the planar head portion through the slit of the slit rings of the connection ends (33) of the projecting connecting elements, and the bead (25) fitting within said slit rings;

and stop means (34) formed on said head portion and dimensioned to accept said pulling force transferred from the pulling means via the projecting connecting elements to the head portion.

2. Apparatus according to claim 1, wherein at least one of the portions of the pulling connection (21) tapers or flares outwardly from a narrow tip adjacent the head portion towards the magnetically responsive, magnetically jointly adhering flexible plate elements.

3. Apparatus according to claim 1, wherein the magnetically responsive, magnetically jointly adhering flexible plate elements comprise flexible sheets of essentially equal size, and at least approximately rectangular configuration—in top view—and extending over at least a major portion of the width of the web to be threaded.

4. Apparatus according to claim 1, wherein the plate elements comprise plastic foil and particles of permanent-magetic material embedded in the plastic foil, the particles of magnetic material being located in groups with one of the poles of particles of any one group being oriented towards one face side of the respective foils.

5. Apparatus according to claim 1 wherein the head portion comprises a plastic coated textile sheet or mat.

6. Apparatus according to claim 1, wherein the intermediate connection element (23) comprises a sheet of polyurethane.

7. Apparatus according to claim 1, wherein said head portion comprises a folded-over plastic coated sheet of textile material, and a section of rope or cable (25) embedded in the fold of the folded-over sheet and defining said bead, the bead extending essentially parallel to the longitudinal slit (31) in the tubular guide track.

* * * * *